US005833090A

United States Patent [19]

Rojek

[11] Patent Number: 5,833,090

[45] Date of Patent: Nov. 10, 1998

[54] METAL LIDS FOR VACUUM-SEALING OF PACKAGING FOR FOODSTUFF PRESERVES

[75] Inventor: Arnaldo Rojek, Sao Paulo, Brazil

[73] Assignee: Metalgrafica Rojek Ltda., Brazil

[21] Appl. No.: 592,854

[22] Filed: Jan. 24, 1996

[30] Foreign Application Priority Data

Jan. 25, 1995 [BR] Brazil ..... 9500311

[51] Int. Cl.[6] ..... B65D 51/16

[52] U.S. Cl. ..... 215/262; 215/307; 220/231; 220/203.11; 220/203.16

[58] Field of Search ..... 215/262, 260, 215/270, 307, 310, 341, 349, 230; 220/361, 363, 364, 365, 231, 367.1; 426/87

[56] References Cited

U.S. PATENT DOCUMENTS

| | | | |
|---|---|---|---|
| 1,985,788 | 12/1934 | Gore-Lloyd | 215/262 |
| 3,462,037 | 8/1969 | Keller | 215/262 |
| 3,736,899 | 6/1973 | Manske | 215/230 X |
| 4,398,491 | 8/1983 | Fridl et al. | 215/262 X |
| 4,448,325 | 5/1984 | Edwards et al. | 220/361 X |
| 5,275,679 | 1/1994 | Rojek | 426/87 X |
| 5,439,724 | 8/1995 | Rojek | 215/349 X |

FOREIGN PATENT DOCUMENTS

| | | | |
|---|---|---|---|
| 118805 | 6/1968 | Denmark | 215/262 |
| 1532430 | 8/1966 | Germany | 215/262 |
| 2274278 | 7/1994 | United Kingdom | 215/262 |

*Primary Examiner*—Gary E. Elkins
*Assistant Examiner*—Nathan Newhouse
*Attorney, Agent, or Firm*—Webb Ziesenheim Bruening Logsdon Orkin & Hanson, P.C.

[57] ABSTRACT

The present invention comprises a metal lid constituted by a circular panel, endowed with downward short turned rim or skirt and provided in its inner peripheral circumference a circular groove containing a sealing gasket and having a circular concave depression disposed preferably in a central portion of the panel, wherein there is formed a central hole and wherein in a lateral portion or sector of this circular depressed area is applied a film of high-adherence varnish, being furthermore filled up with an adherent thermoplastic and melting material-former of the seal that penetrates in the hole, forming a short vertical rod, which does not extravasate the hole and remains with its end close and at the same plane of the internal and inferior surface of the panel of the lid without forcing any portion or residue of the material in the inferior part of the hole and further wherein, the film of high-adherence varnish, applied in a lateral part or sector of the circular depression, allows the partial retention of the seal on the occasion of its lifted slightly and release of the relief hole, and the reapplying after the first opening of the packaging.

5 Claims, 4 Drawing Sheets

METAL LIDS FOR VACUUM-SEALING OF PACKAGING FOR FOODSTUFF PRESERVES

BACKGROUND OF THE INVENTION

The present invention relates to improvements in metal lids for vacuum-sealing of packagings for fooodstuff preserves. These lids are provided with easy opening means, as are those which are the object of Brazilian Patents No. 8800359-0 and No. 9103896-0 by the same inventor.

As can be seen from said patents, these prior art lids each provide a kind of metal lid broadly applied to closed glasses, vessels and other packagings for foodstuff preserves closed by seaming or only by the action of the vacuum which is formed inside the vessels. These prior art lids include means to enable the easy opening of the lid by means of forming a hole relief disposed in the panel of the lid. The hole relief is closed by a removable seal of thermoplastic resin. Extraction of the seal causes a vacuum release in the moment of its use by inlet of atmospheric air and the consequent relief or release of the lid without requiring the use of tools or any other accessory for opening the seal.

Although this seal and respective relief hole have satisfied their practical purposes, they showed in practice some inconveniences. Such inconveniences include occasional prejudice of the release of the hole by the resistance provided in the moment of extraction of the seal and concomitant passage of a film of adherent material through its inferior part (as discussed in Brazilian Patent No. 9103896-0). Furthermore, on the occasion of the extraction of the seal, residues of the resinous material may remain encrusted in the hole, prejudicing its release or, further, such residues may be released and fall into the product inside the packaging.

SUMMARY OF THE INVENTION

In order to find a definitive solution for such problems, a new constructive form and execution of the seal was realized, the release of the relief hole becoming safer and more efficient, moreover allowing that the seal is not completely extracted from the depressed area wherein it is applied. After the first opening of the lid, the seal under pressure in the lid is reapplied, closing the hole and allowing the reutilization of the lid in perfect condition as a hygenic cover for the remainder part of the product inside the packaging, excluding the necessity of a complementary lid for such purpose.

BRIEF DESCRIPTION OF THE DRAWINGS

The improvements introduced in metal lids for vacuum-sealing of packagings for foodstuff preserves are presented in the appended drawings, in which.

DESCRIPTION OF THE PREFERRED EMBODIMENT

Figure 1:
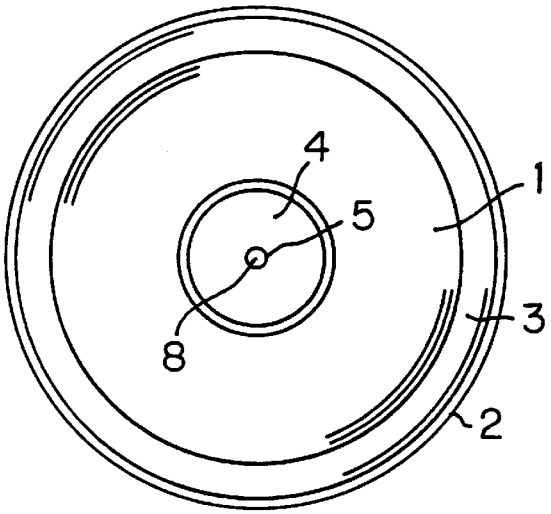
FIG. 1—lower view of the metal lid, in the execution form which is an object of this invention.
Figure 2:
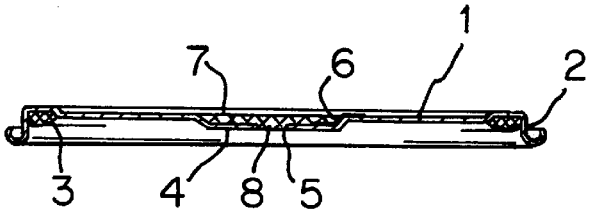
FIG. 2—view in lateral elevation and in diametral cross-section.

The improvements introduced in metal lids for vacuum-sealing of packagings for foodstuff preserves as shown in the drawings which are appended to the present descriptive report include a metal lid, usually constituted by a circular panel 1 endowed with a downward short turned rim or skirt 2 and provided in its inner peripheral of a circular groove containing a sealing gasket 3. The panel 1 has a circular concave depression 4 disposed preferably in a central portion of the panel 1, wherein there is formed a central hole 5.

A little part or sector of this depressed area 4 receives, over lithographic paints, which usually cover the superior surface of the panel 1, a film of high-adherence varnish 6. The film 6 is placed in one of the two sides of the depressed area 4, in which an adherent and melting material with gluing properties is applied. The adherent and melting material fills up the depressed area 4 forming a seal 7. The material-former of the seal 7 penetrates the hole 5 forming a short vertical rod 8, which does not extravasate the hole 5 and remains with its end close and in the same plane as the internal and inferior surface of the panel 1 of the lid, so as to not form, in the inferior part of the hole 5, any residue of the material-former of the seal.

Figure 3:
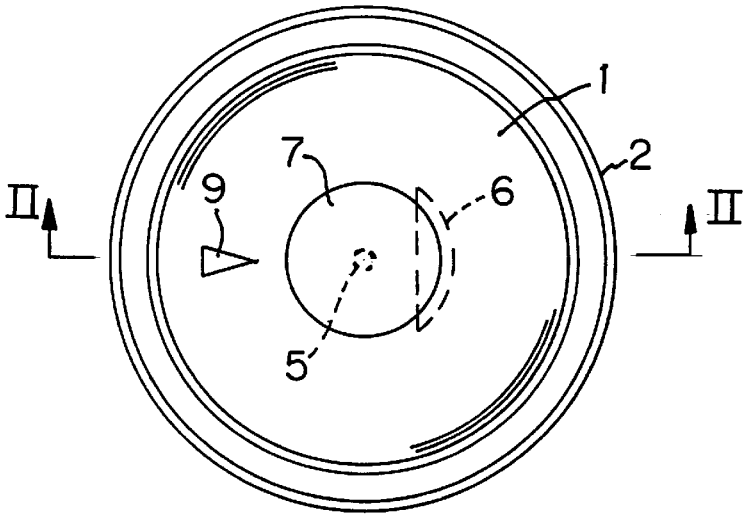
FIG. 3—top view.
Figure 4:
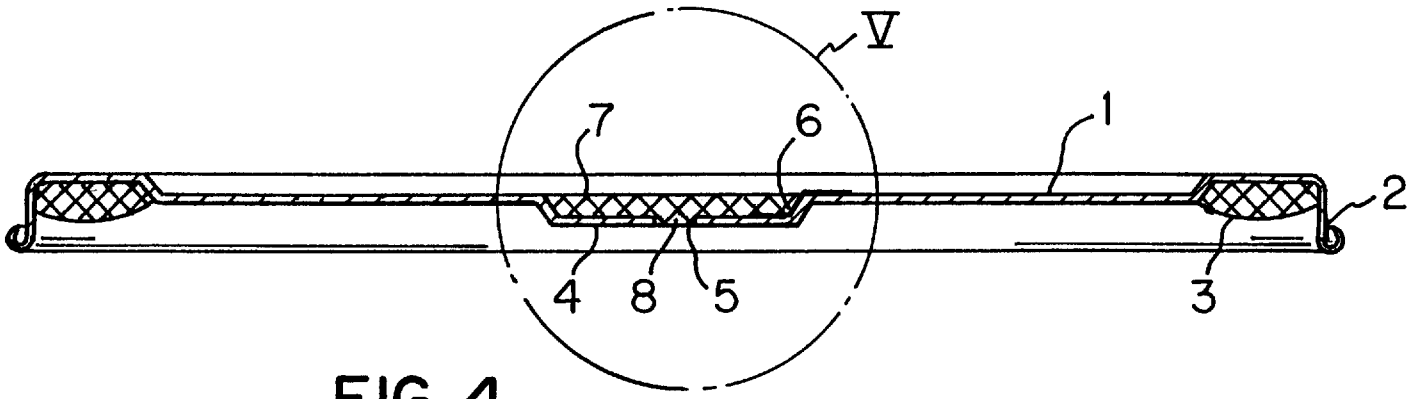
FIG. 4—diametral cross-section and enlarged view of the lid, with the new form of execution of the seal of the relief hole.
Figure 5:
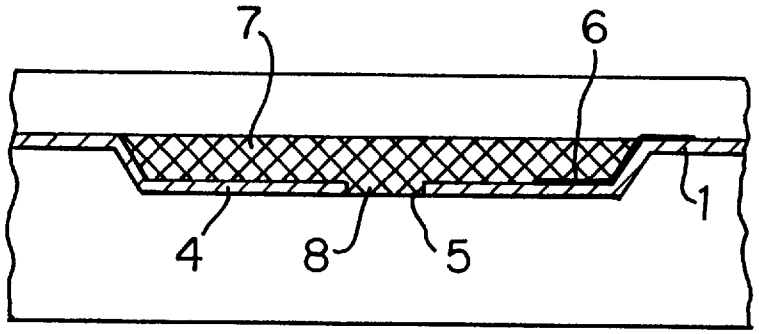
FIG. 5—enlarged view and in detail of the correspondent part of the removable seal.
Figure 6:
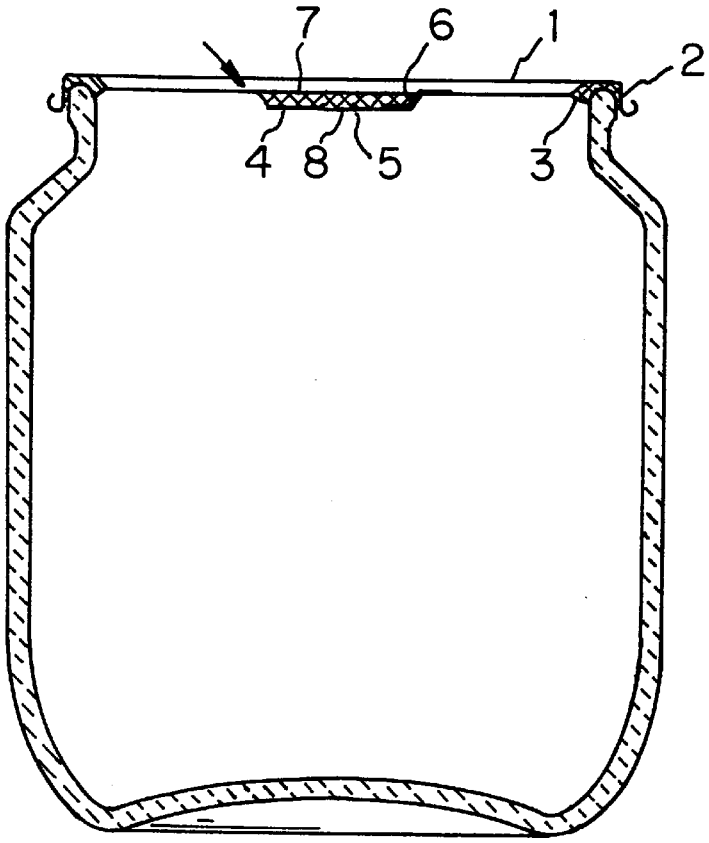
FIG. 6—lateral view and in diametral cross-section, showing the metal lid applied in a packing vessel and in its position of vacuum-closing.
Figure 7:
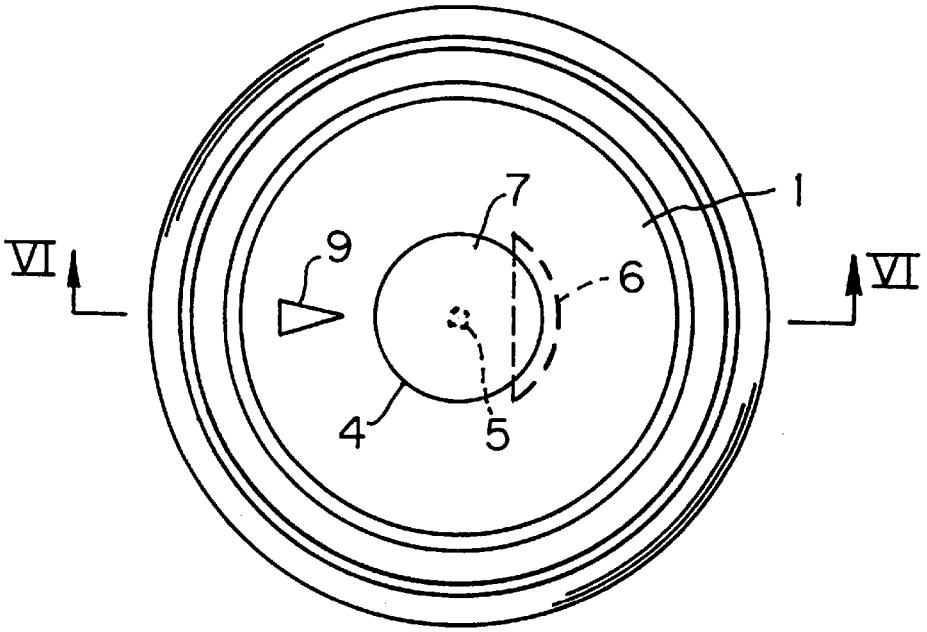
FIG. 7—superior view of the metal lid applied in the packing-vessel.
Figure 8:
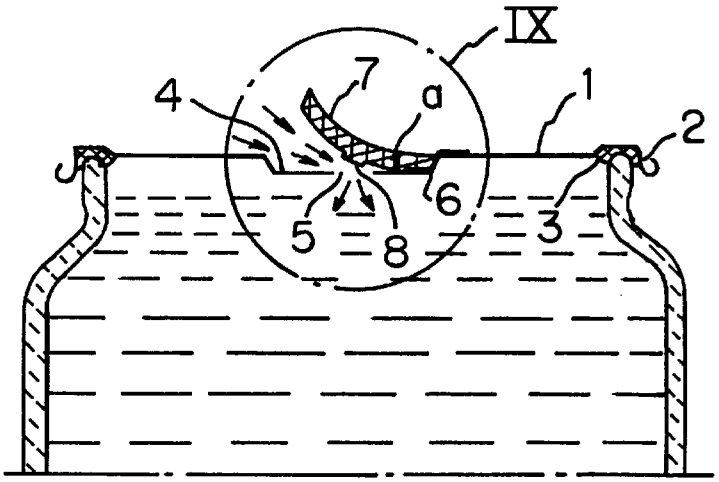
FIG. 8—partial view of a packaging vessel, having a metal lid with its seal in position of release, allowing the air atmospheric inlet and consequent release of the vacuum retainer of the lid.
Figure 9:
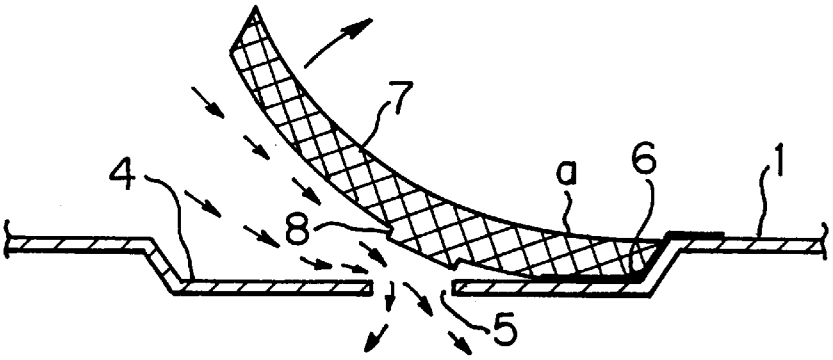
FIG. 9—enlarged view in detail, showing the seal in position of partial and enough extraction for the total release of the relief hole.
Figure 10:
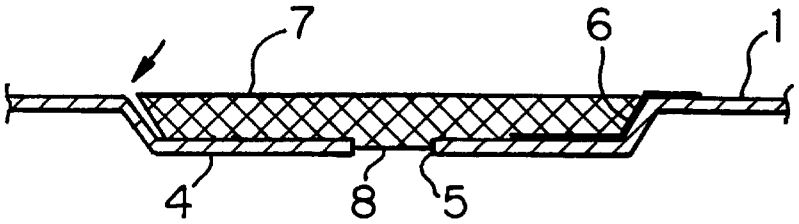
FIG. 10—lateral view and in diametral cross-section of the correspondent part of the seal, showing its reposition for closing of the relief hole.

According to this new constructive form as shown in FIGS. 8 and 9, the seal of the relief hole 5 is slightly raised in the moment of opening the lid by means of the utilization of the fingernail of the user on the opposite side of which the film 6 of high-adherence varnish is applied (indicated by an arrow 9 in FIG. 7). As can be seen in FIGS. 3 and 7, only one part of the seal 7 is extracted. Enough of the seal 7 is extracted to allow for the total release of the relief hole 5, and inlet of the atmospheric air (see arrows in FIGS. 8 and 9). The other part of the seal 7 (indicated by "a") will remain fast glued in the respective area covered with the film 6 of high-adherence varnish, so that, after the first opening of the packaging, the reapplication under pressure of the seal 7 will be enabled. With the introduction of the rod 8 in hole 5, the lid can be normally reutilized as a hygenic cover for the remainder part of the product inside the packaging.

As it is shown, this new way of execution of the seal 7 excludes the formation of any obstruction in the inferior part of the hole 5, which can provoke the retention and obstruct the free extraction of the seal in the moment of its removal. The present invention eliminates completely the possibility of residues of the material-former of the seal or material released falling on the product inside the packaging or remaining encrusted in the hole 5. The present invention also has the advantage of potential reutilization of the seal by the closing of the relief hole.

What is claimed is:

1. A metal lid for vacuum-sealing packagings for foodstuff preserves, comprising:

a circular panel having a skirt, a circular groove in the inner peripheral circumference of an inferior surface of said panel, said groove containing a sealing gasket, said panel further having a circular concave depression disposed in a portion of said panel and a central hole formed in said depression;

a seal filling said depression, said seal comprising an adherent thermoplastic and melting material, wherein said adherent material penetrates said hole and forms a short vertical rod which does not extravasate said hole below said inferior surface; and a film of high-adherence varnish between a sector of said depression and said seal.

2. The metal lid of claim 1 wherein the end of said vertical rod is disposed in the plane of said inferior surface of said panel.

3. The metal lid of claim 2 wherein said film of high-adherence varnish partially retains said seal when said seal is lifted slightly and said rod is released from said hole.

4. The metal lid of claim 3 wherein when said seal is reapplied after lifting slightly said seal, said rod may be reintroduced into said hole.

5. The metal lid of claim 1 wherein said film of high-adherence varnish is applied to one of two sides of said seal.

* * * * *